US010108126B2

(12) United States Patent
Tanaka et al.

(10) Patent No.: US 10,108,126 B2
(45) Date of Patent: Oct. 23, 2018

(54) IMAGE FORMING APPARATUS WITH AN IMPROVED VOLTAGE CONTROLLED LIGHT EMITTER

(71) Applicant: KYOCERA Document Solutions Inc., Osaka (JP)

(72) Inventors: Hiroki Tanaka, Osaka (JP); Atsushi Ishizaki, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 15/454,780

(22) Filed: Mar. 9, 2017

(65) Prior Publication Data

US 2017/0261904 A1 Sep. 14, 2017

(30) Foreign Application Priority Data

Mar. 11, 2016 (JP) ..... 2016-047967

(51) Int. Cl.
*G03G 15/00* (2006.01)

(52) U.S. Cl.
CPC ..... *G03G 15/556* (2013.01)

(58) Field of Classification Search
CPC ..... G03G 15/0131; G03G 15/5033; G03G 15/5041; G03G 15/5058; G03G 15/5062; G03G 15/556
See application file for complete search history.

(56) References Cited

U.S. PATENT DOCUMENTS

2006/0204267 A1 9/2006 Watanabe
2011/0311245 A1* 12/2011 Inada ..... G03G 15/0131 399/31

FOREIGN PATENT DOCUMENTS

JP 2006-201521 8/2006

* cited by examiner

*Primary Examiner* — Hoang Ngo

(57) ABSTRACT

In a sensor, a light emitter outputs light with which a toner pattern on an image carrier or a surface material of the image carrier is irradiated, and a photodetector receives reflection light from the toner pattern or the surface material. The sensor light intensity control unit provides a control voltage to the light emitter and controls light intensity thereof. The density determining unit determines a toner density on the basis of output of the photodetector. Further, the density determining unit determines a reference control voltage of the light emitter to set as a predetermined value the output of the photodetector corresponding to the reflection light from the surface material, determines a correction parameter corresponding to the reference control voltage, determines a correction amount corresponding to the correction parameter and the toner density, and corrects the toner density on the basis of the correction amount.

4 Claims, 9 Drawing Sheets

IMAGE FORMING APPARATUS WITH AN IMPROVED VOLTAGE CONTROLLED LIGHT EMITTER

CROSS-REFERENCE TO RELATED APPLICATIONS

This application relates to and claims priority rights from Japanese Patent Application No. 2016-047967, filed on Mar. 11, 2016, the entire disclosures of which are hereby incorporated by reference herein.

BACKGROUND

1. Field of the Present Disclosure

The present disclosure relates to an image forming apparatus.

2. Description of the Related Art

A measurement method of a toner density on an image carrier using a reflection type optical sensor calculates an index (e.g. coverage factor mentioned below or the like) that indicates a toner density on the basis of a change of an output voltage of the reflection type optical sensor.

Such reflection type sensor is of a specular-reflection-and-diffuse-reflection-separating type or of a polarization splitting type.

Of the specular-reflection-and-diffuse-reflection-separating type, the reflection type sensor includes two photodetectors that receive specular reflection light and diffuse reflection light, respectively. Specifically, the specular-reflection photodetector is arranged on an optical axis of reflection light of incoming light, and the diffuse-reflection photodetector is arranged out of the optical axis. Outputs of these photodetectors are used for the detection of the toner density.

The polarization splitting type utilizes a polarization characteristic of color toner, and arranges a beam splitter, causes a specific polarized light to enter the beam splitter, splits the reflection light into P-polarized light and S-polarized light using the beam splitter, and receives the P-polarized light and the S-polarized light using two photo detectors. Outputs of these photodetectors are used for the detection of the toner density.

The detection of the toner density is performed on the basis of a ratio between a sensor output of a surface material part of the image carrier (i.e. a surface part on which toner does not adhere) and a sensor output of a toner part (i.e. a surface part on which toner adheres). Using this ratio gives an advantage to enable to exclude influence of dirt on a head part of a light emitting unit in an optical sensor, light intensity fluctuation of an LED (Light Emitting Diode) as a light emitter of an optical sensor and the like.

Under a condition that all incoming light to black toner is absorbed by the black toner and incoming light to color toner diffusely reflects completely, regardless of toner type (i.e. black toner or color toner), a coverage factor M of toner on an image carrier is expressed as the following formula.

$$M=1-\{(P-Pd)-(S-Sd)\}/\{(Pg-Pd)-(Sg-Sd)\}$$

Here Pd is a dark potential of the specular-reflection light (P-polarized light) photodetector, Sd is a dark potential of the diffuse-reflection light (S-polarized light) photodetector, Pg is a P-polarized light component from the surface material of the image carrier, Sg is an S-polarized light component from the surface material of the image carrier, P is a P-polarized light component from the toner part, and S is an S-polarized light component from the toner part.

Even if actual toner densities of toner patterns on the image carrier are identical to each other, the coverage factors M (i.e. measured toner densities) of the toner patterns may be different from each other.

An image forming apparatus uses a multi-layer rubber transfer belt including an elastic layer as an image carrier on which a toner patter is measured by an optical sensor; and external additive of toner (i.e. abrasive that polishes a photoconductor) adheres on a surface of such transfer belt and thereby surface nature of the transfer belt may vary. It is proposed that in such a case, the endurance X ($X=A\times\{1-(Sg-Sd)/(Pg-Pd)\}$, A: constant) is calculated from a sensor output, and the coverage M is corrected on the basis of the endurance X.

In general, a substance such as toner adheres on a transfer belt and thereby Sg, i.e. (Sg−Sd) increases due to a polarization characteristic of the adhering substance; and contrarily, Pg, i.e. (Pg−Pd) increases due to polishing the image carrier through use. Therefore, regarding a transfer belt originally having a high surface glossiness and a used transfer belt having a high surface glossiness due to toner adhering and polishing, it is supposed that even if (Pg−Pd) of the both transfer belt are equal to each other, (Sg−Sd) are different from each other, and consequently the endurances X are different from each other.

Further, when the glossiness of the belt surface material is high, since direct reflection light is much from the belt surface, Pg is high. Therefore, when the glossiness of the belt surface material is high, the term {(Pg−Pd)−(Sg−Sd)} is high in the calculation formula of the coverage factor M.

On the other hand, in a high toner density range, the influence of the belt surface material is small, and therefore, a value of the term {(P−Pd)−(S−Sd)} does not vary widely.

Consequently, the coverage factor M of the transfer belt is calculated as higher value due to a higher glossiness of the transfer belt Meanwhile, as shown in FIG. 9, even if the glossinesses of the transfer belts are different from each other, the aforementioned endurances X may be substantially identical to each other. FIG. 9 shows a diagram that indicates an example of a relationship between a glossiness (a measurement value by a glossmeter) and an endurance X at plural conditions of a transfer belt.

For example, the endurance X at an initial state of a low glossy transfer belt and the endurance X of a used high glossy transfer belt can be substantially identical to each other.

In a case that the endurances X are identical to each other but the glossinesses are different from each other, even if the coverage factor M is corrected on the basis of the endurance X, the correction is not properly performed in consideration of the glossiness, and consequently, the coverage factor M varies in accordance with the glossiness.

It should be noted that it is possible to set a glossmeter, measure a glossiness of a transfer belt using the glossmeter, and correct a coverage factor on the basis of the obtained glossiness, but in a such case, setting the glossmeter causes a high cost of the apparatus.

SUMMARY

An image forming apparatus according to an aspect of the present disclosure includes an image carrier configured to carry a toner pattern, a sensor, a sensor light intensity control unit, and a density determining unit. The sensor includes a light emitter and a photodetector. The light emitter is configured to output light with which the toner pattern or a surface material of the image carrier is irradiated. The photodetector is configured to receive reflection light from the toner pattern or the surface material of the image carrier. The sensor light intensity control unit is configured to provide a control voltage to the light emitter and thereby control light intensity of the light emitter. The density determining unit is configured to determine a toner density on the basis of output of the photodetector. Further, the density determining unit (a) determines a reference control voltage of the light emitter to set as a predetermined value the output of the photodetector corresponding to the reflection light from the surface material of the image carrier, (b) determines a correction parameter corresponding to the reference control voltage, (c) determines a correction amount corresponding to the correction parameter and the toner density, and (d) corrects the toner density on the basis of the correction amount.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
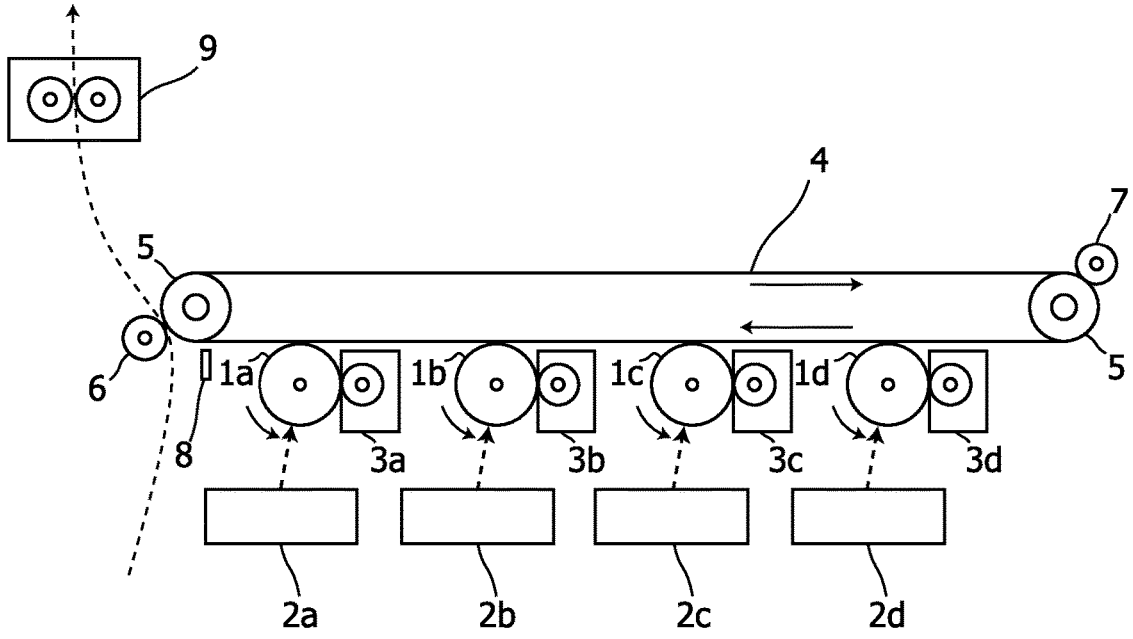
FIG. 1 shows a side view that indicates an internal mechanical configuration of an image forming apparatus in an embodiment according to the present disclosure.

FIG. 1 shows a side view that indicates an internal mechanical configuration of an image forming apparatus in an embodiment according to the present disclosure. The image forming apparatus shown in FIG. 1 is an apparatus having a printing function such as a printer, a facsimile machine, a copier, or a multi function peripheral.

The image forming apparatus in the present embodiment includes a tandem-type color development device. This color development device includes photoconductor drums 1*a* to 1*d*, exposure devices 2*a* to 2*d*, and development devices 3*a* to 3*d* for respective colors. The photoconductor drums 1*a* to 1*d* are photoconductors of four colors: Cyan, Magenta, Yellow and Black. The exposure devices 2*a* to 2*d* are devices that form electrostatic latent images by irradiating the photoconductor drums 1*a* to 1*d* with laser light. Each of the exposure devices 2*a* to 2*d* includes a laser diode as a light emitter of the laser light, optical elements (such as lens, mirror and polygon mirror) that guide the laser light to the photoconductor drum 1*a*, 1*b*, 1*c*, or 1*d*.

Further, in the periphery of each one of the photo conductor drums 1*a* to 1*d*, a charging unit, a cleaning device, a static electricity eliminator and the like are disposed. The charging device is of a scorotron type or the like and charges the photoconductor drum 1*a*, 1*b*, 1*c*, or 1*d*. The cleaning device removes residual toner on each one of the photo conductor drums 1*a* to 1*d* after primary transfer. The static electricity eliminator eliminates static electricity of each one of the photo conductor drums 1*a* to 1*d* after primary transfer.

Toner containers are attached to the development devices 3*a* to 3*d*, and the toner containers are filled up with toner of four colors: Cyan, Magenta, Yellow and Black, respectively. Development biases are applied between the development devices 3*a* to 3*d* and the photoconductor drums 1*a* to 1*d*, respectively, and thereby the development devices 3*a* to 3*d* cause the toner supplied from the toner containers to adhere to electrostatic latent images on the photoconductor drums 1*a* to 1*d*, respectively, and consequently form toner images of the four colors. For example, a developer is composed of the toner and a carrier with external additives such as titanium dioxide.

The photoconductor drum 1*a*, the exposure device 2*a* and the development device 3*a* perform development of Magenta. The photoconductor drum 1*b*, the exposure device 2*b* and the development device 3*b* perform development of Cyan. The photoconductor drum 1*c*, the exposure device 2*c* and the development device 3*c* perform development of Yellow. The photoconductor drum 1*d*, the exposure device 2*d* and the development device 3*d* perform development of Black.

The intermediate transfer belt 4 is an image carrier and endless (i.e. loop-shaped) intermediate transferer that contacts the photoconductor drums 1*a* to 1*d*. Toner images on the photoconductor drums 1*a* to 1*d* are primarily transferred onto the intermediate transfer belt 4. The intermediate transfer belt 4 is hitched around driving rollers 5, and rotates by driving force of the driving rollers 5 towards the direction from the contact position with the photoconductor drum 1*d* to the contact position with the photoconductor drum 1*a*.

In this embodiment, for example, the intermediate transfer belt 4 is a multi-layer rubber transfer belt including an elastic layer. A surface of such intermediate transfer belt 4 has a reflection characteristic that varies due to plural factors such as polishing due to cleaning residual toner, deposition of residual toner, and deposition of external additives.

Therefore, P-polarized light component of the reflection light from a surface material part of the intermediate transfer belt 4 does not decrease monotonically over time, and consequently even though some usage situations result in different glossinesses, unfortunately, the aforementioned endurances X may be identical.

A transfer roller 6 causes a conveyed paper sheet to contact the transfer belt 4, and secondarily transfers the toner image on the transfer belt 4 to the paper sheet. The paper sheet on which the toner image has been transferred is conveyed to a fuser 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet. Instead of the roller 7 having a cleaning brush, a cleaning blade may be used.

A sensor 8 irradiates the intermediate transfer belt 4 with a light beam and detects its reflection light in order to detect a toner density. In density adjustment, a test toner pattern is formed on the intermediate transfer belt 4, and the sensor 8 irradiates with a light beam a predetermined area where the test toner pattern passes, detects its reflection light, and outputs an electrical signal corresponding to the detected intensity of the reflection light.

Figure 2:
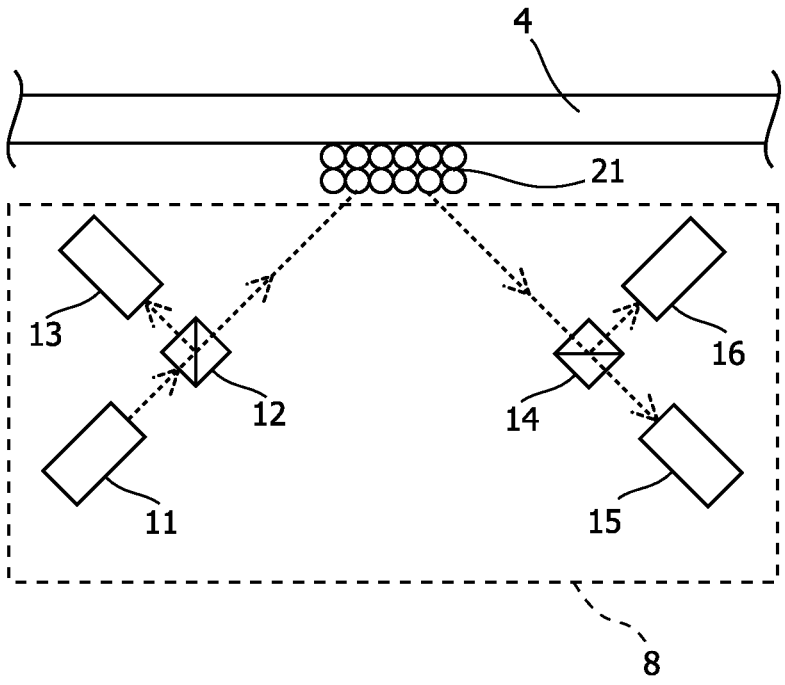
FIG. 2 shows a diagram that indicates an example of a configuration of a sensor 8 in FIG. 1.

FIG. 2 shows a diagram that indicates an example of a configuration of a sensor 8 in FIG. 1.

As shown in FIG. 2, the sensor 8 includes a light emitter 11 which emits a light beam, a beam splitter 12 on the light emitting side, a photodetector 13 on the light emitting side, a beam splitter 14 on the light receiving side, a first photodetector 15, and a second photodetector 16.

The light emitter 11 is a light emitting element (e.g. Light Emitting Diode) that outputs light with which a toner pattern on the intermediate transfer belt 4 is irradiated. The beam splitter 12 transmits a P-polarized light component and reflects an S-polarized light component in a beam from the light emitter 11. The photodetector 13 on the light emitting side is, for example, a photo diode, and detects the S-polarized component from the beam splitter 12, and outputs an electrical signal corresponding to the detected intensity of the S-polarized component. This signal is used for stabilizing control of the light emitter 11.

The P-polarized component light transmitted through the beam splitter 12 on the light emitter side is incident to a surface (i.e. either a toner image 21 or the surface material) of the intermediate transfer belt 4 and reflects. This reflection light contains a specular reflection component and a diffuse reflection component. The specular reflection component is P-polarized. As mentioned, the beam splitter 12 is a polarizer that transmits only a specific polarized light component (here P-polarized light component).

The beam splitter 14 transmits a P-polarized light component (i.e. the specular reflection component) and reflects an S-polarized light component in the reflection light. The photodetectors 15 and 16 receive reflection light from the toner pattern or the surface material of the intermediate transfer belt 4. The first photodetector 15 is, for example, a photo diode, and detects the P-polarized light component (i.e. specular reflection component) transmitted through the beam splitter 14, and outputs an electrical signal corresponding to the detected intensity of the P-polarized light component. The second photodetector 16 is, for example, a photo diode, has the same light detecting characteristic as the first photodetector 15, and detects the S-polarized light component (i.e. diffuse reflection component) transmitted through the beam splitter 14, and outputs an electrical signal corresponding to the detected intensity of the S-polarized light component.

Figure 3:
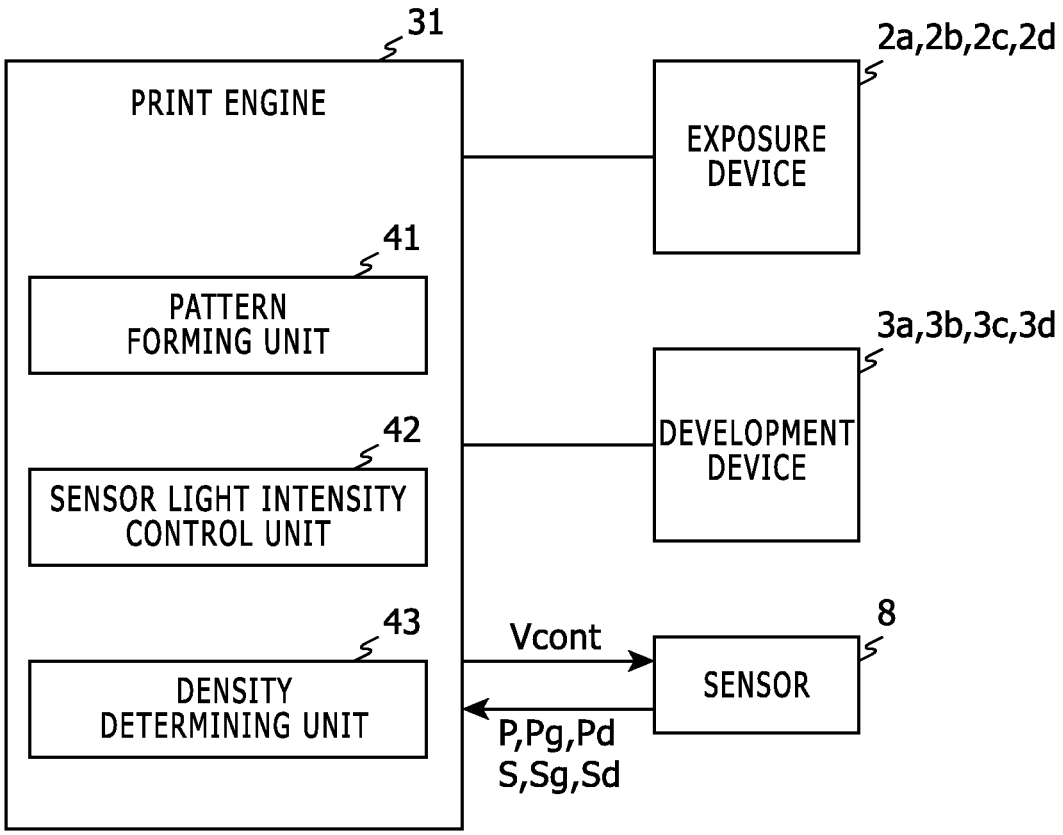
FIG. 3 shows a block diagram that indicates an electronic configuration of the image forming apparatus in the embodiment according to the present disclosure.

FIG. 3 shows a block diagram that indicates an electronic configuration of the image forming apparatus in the embodiment according to the present disclosure. In FIG. 3, the print engine 31 controls a driving source that drives the aforementioned rollers, a bias induction circuit that induces a primary transfer bias, the development device 3*a* to 3*d*, the exposure devices 2*a* to 2*d* and the like, and thereby performs developing, transferring and fixing the toner image, feeding a paper sheet, printing on the paper sheet, and outputting the paper sheet. The primary transfer bias is induced between the photoconductor drums 1*a* to 1*d* and the intermediate transfer belt 4, respectively. The print engine 31 is a processing circuit that includes a computer that acts in accordance with a control program, an ASIC (Application Specific Integrated Circuit) and/or the like.

Further, the print engine 31 controls the sensor 8 and thereby at regular intervals or predetermined timing, performs an adjustment (calibration) of density gradation, maximum density and/or the like. D/A (Digital to Analog) converters, amplifiers and the like are disposed between the print engine 31 and the light emitter 11 if necessary. Amplifiers, A/D (Analog to Digital) converters and the like are disposed between the photodetectors 15 and 16 and the print engine 31 if necessary.

The print engine 31 includes a pattern forming unit 41, a sensor light intensity control unit 42, and a density determining unit 43.

In the calibration, the pattern forming unit 41 controls the exposure devices 2*a* to 2*d* and the development devices 3*a* to 3*d* and thereby forms toner patterns of respective toner colors on the intermediate transfer belt 4.

The sensor light intensity control unit 42 supplies a control voltage to the light emitter 11, and thereby controls emitting light intensity of the light emitter 11. The sensor 8 makes light incident to the toner patterns on the intermediate transfer belt 4, and receives reflection light thereof.

The density determining unit 43 determines a toner density on the basis of output of the photodetector.

Specifically, the density determining unit 43 (*a*) determines a reference control voltage Vcont of the light emitter 11 to set as a predetermined value the output of the photodetector 15 corresponding to the reflection light from the surface material of the intermediate transfer belt 4 (i.e. the output of the photoconductor for the P-polarized light component), (b) determines a correction parameter G corresponding to the reference control voltage Vcont, (c) determines a correction amount corresponding to the correction parameter G and the toner density, and (d) corrects the toner density on the basis of the correction amount. For example, the toner density (before the correction) is calculated as the aforementioned coverage factor M according to the following formula.

$$M=1-\{(P-Pd)-(S-Sd)\}/\{(Pg-Pd)-(Sg-Sd)\}$$

Further, the correction parameter G may be a parameter in proportion to the reference control voltage Vcont or may be a parameter in inverse proportion to the reference control voltage Vcont.

For example, the correction parameter G may be equal to the reference control voltage Vcont (i.e. G=Vcont).

Further, for example, the correction parameter G may be obtained by dividing a substantial difference between the detection voltage of the P-polarized light component and the detection voltage of the S-polarized light component {(Pg−Pd)−(Sg−Sd)} by the reference control voltage Vcont (i.e. G={(Pg−Pd)−(Sg−Sd)}/Vcont).

Figure 4:
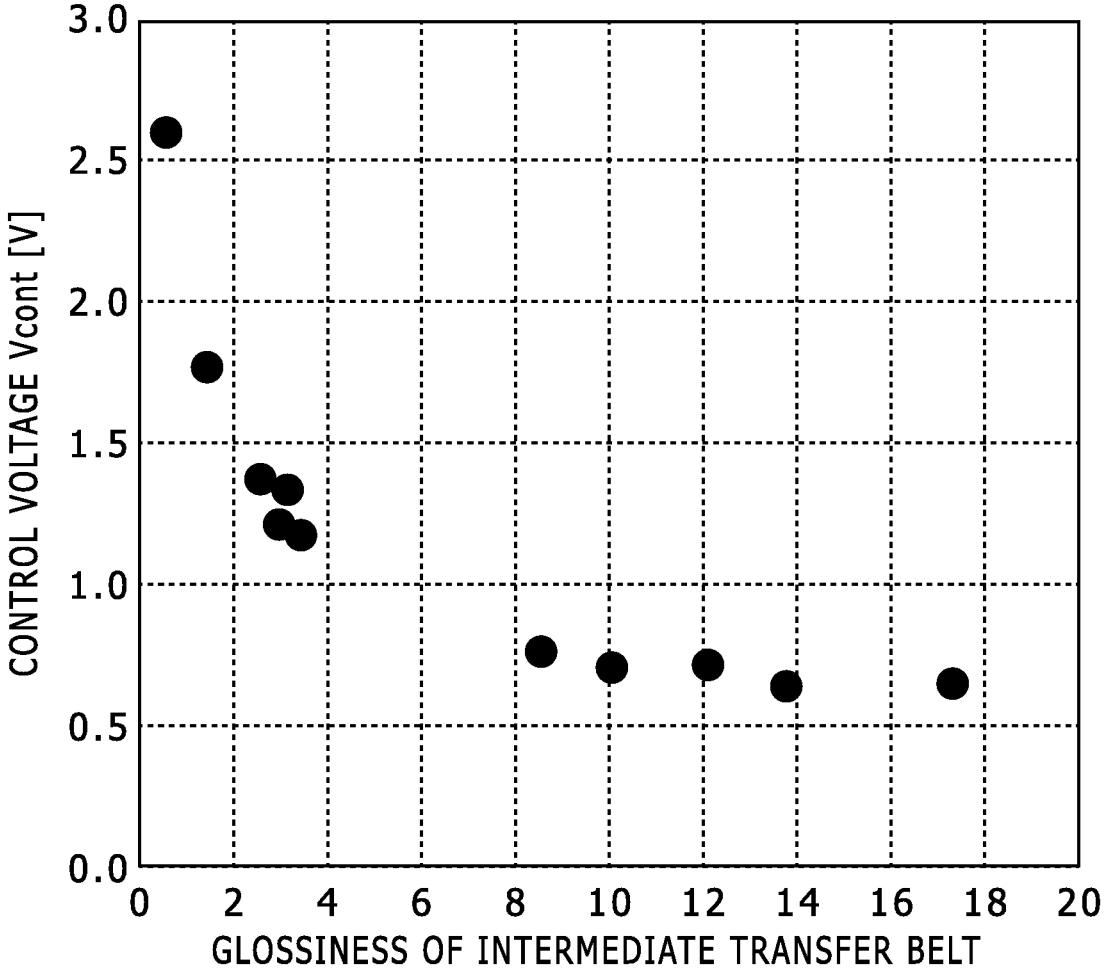
FIG. 4 shows a diagram that explains a relationship between a glossiness of an intermediate transfer belt 4 and a reference control voltage Vcont.

FIG. 4 shows a diagram that explains a relationship between a glossiness of an intermediate transfer belt 4 and a reference control voltage Vcont. As shown in FIG. 4, there is a correlation between the surface glossiness of the intermediate transfer belt 4 and the reference control voltage Vcont of the sensor. This glossiness means a reflectance of the direct reflection light, and the doubled glossiness gives a substantially doubled slope of a relation of Pg to the reference control voltage Vcont. Therefore, the doubled glossiness gives substantially ½ times of the reference control voltage Vcont. Thus, the reference control voltage Vcont has a characteristic of inverse proportion to the glossiness.

Figure 5:
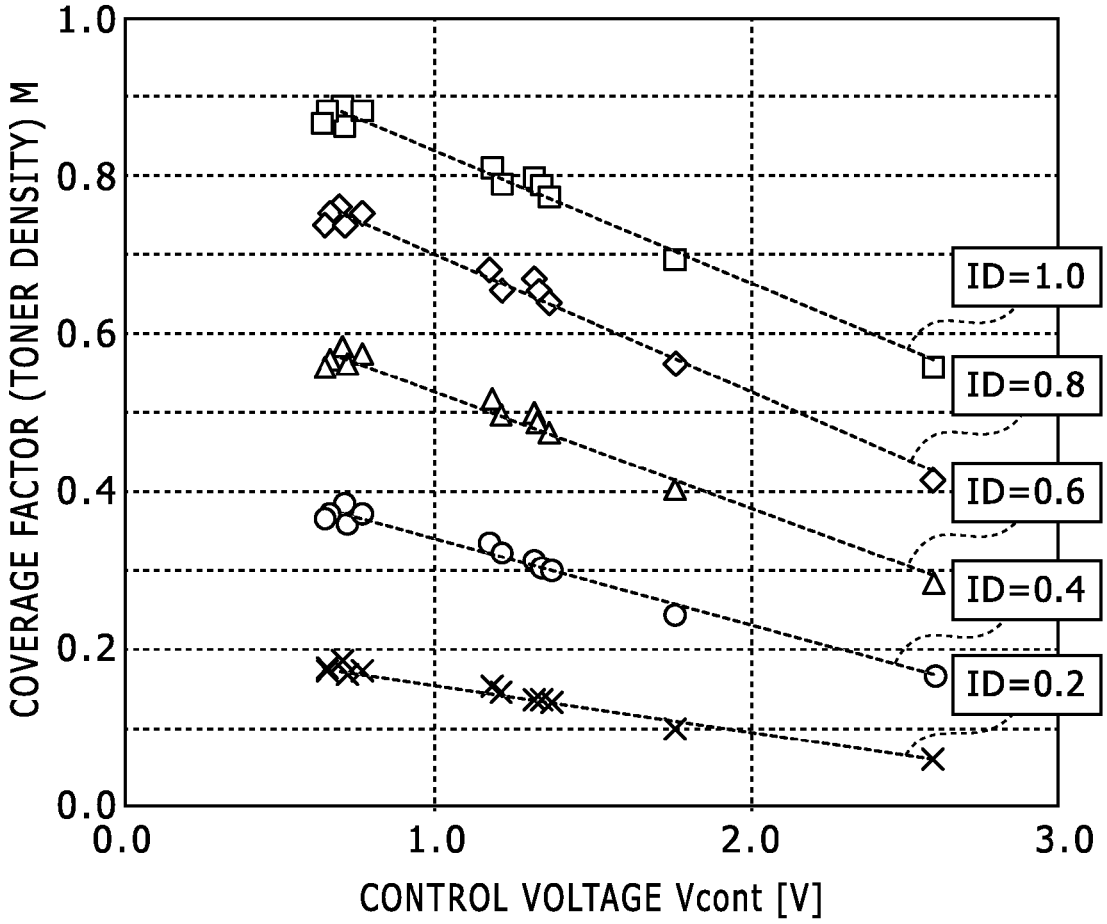
FIG. 5 shows a diagram that explains a relationship between the reference control voltage Vcont and a coverage factor (toner density) M.
Figure 6:
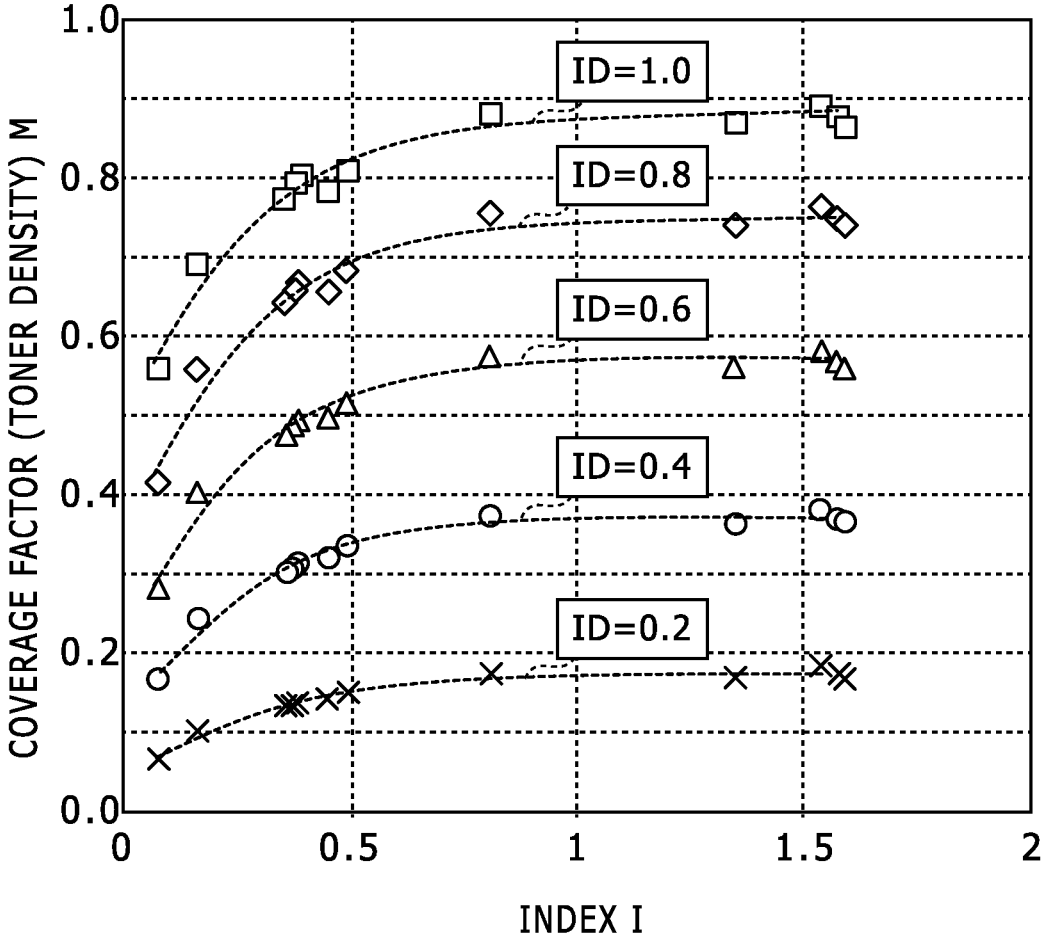
FIG. 6 shows a diagram that explains a relationship between an index I in inverse proportion to the reference control voltage Vcont ($I=\{(Pg-Pd)-(Sg-Sd)\}/Vcont$) and a coverage factor (toner density) M.

FIG. 5 shows a diagram that explains a relationship between the reference control voltage Vcont and a coverage factor (toner density) M. FIG. 6 shows a diagram that explains a relationship between an index I in inverse proportion to the reference control voltage Vcont ($I=\{(Pg-Pd)-(Sg-Sd)\}/Vcont$) and a coverage factor (toner density) M.

FIGS. 5 and 6 indicate the coverage factor M where a transmission density ID (Image Density) falls into a range of 0.2 to 1.0 at plural states of the reference control voltage Vcont and the index I. FIGS. 5 and 6 indicates a case that (a) a photo-detection output characteristic is linear to a control voltage applied by the sensor light intensity control unit 42 and (b) a sensor used as the sensor 8 does not have an insensible range where a photo-detection output does not change in a low control voltage range.

The lower the reference control voltage Vcont, the higher the glossiness of the intermediate transfer belt 4 is; and the higher the reference control voltage Vcont, the lower the glossiness of the intermediate transfer belt 4 is. Thus, both the reference control voltage Vcont and the index I have a correlation to the glossiness, and therefore, in order to restrain influence of variation of the glossiness of the intermediate transfer belt 4, whichever of the reference control voltage Vcont and the index I can be applied to the correction of the toner density.

In other words, as the aforementioned correction parameter G, whichever of the reference control voltage Vcont and the index I can be used.

Further, as mentioned, the reference control voltage is in inverse proportion to the glossiness, and therefore, in the relation shown in FIG. 5, a resolution is high in a low range of the reference control voltage Vcont (i.e. in a high range of the glossiness). Contrarily, in the relation shown in FIG. 6, a resolution is high in a high range of the reference control voltage Vcont (i.e. in a low range of the glossiness).

On the basis of the difference on the characteristic of the resolution, when the glossiness of the intermediate transfer belt 4 is low (i.e. when the reference control voltage Vcont is high), using the index I accurately corrects the toner density, and when the glossiness of the intermediate transfer belt 4 is high (i.e. when the reference control voltage Vcont is low), using the reference control voltage Vcont accurately corrects the toner density.

Therefore, the correction parameter G may be set in proportion to the reference control voltage Vcont in a first mode and is set in inverse proportion to the reference control voltage Vcont in a second mode; and in such a case, the density determining unit 43 may change one to the other among the first mode and the second mode in accordance with the reference control voltage Vcont, and determine the correction parameter. Specifically, if the reference control voltage Vcont is lower than a predetermined threshold value, then the density determining unit 43 determines the correction parameter G in the first mode; and otherwise if not, then the density determining unit 43 determines the correction parameter G in the second mode.

Figure 7:
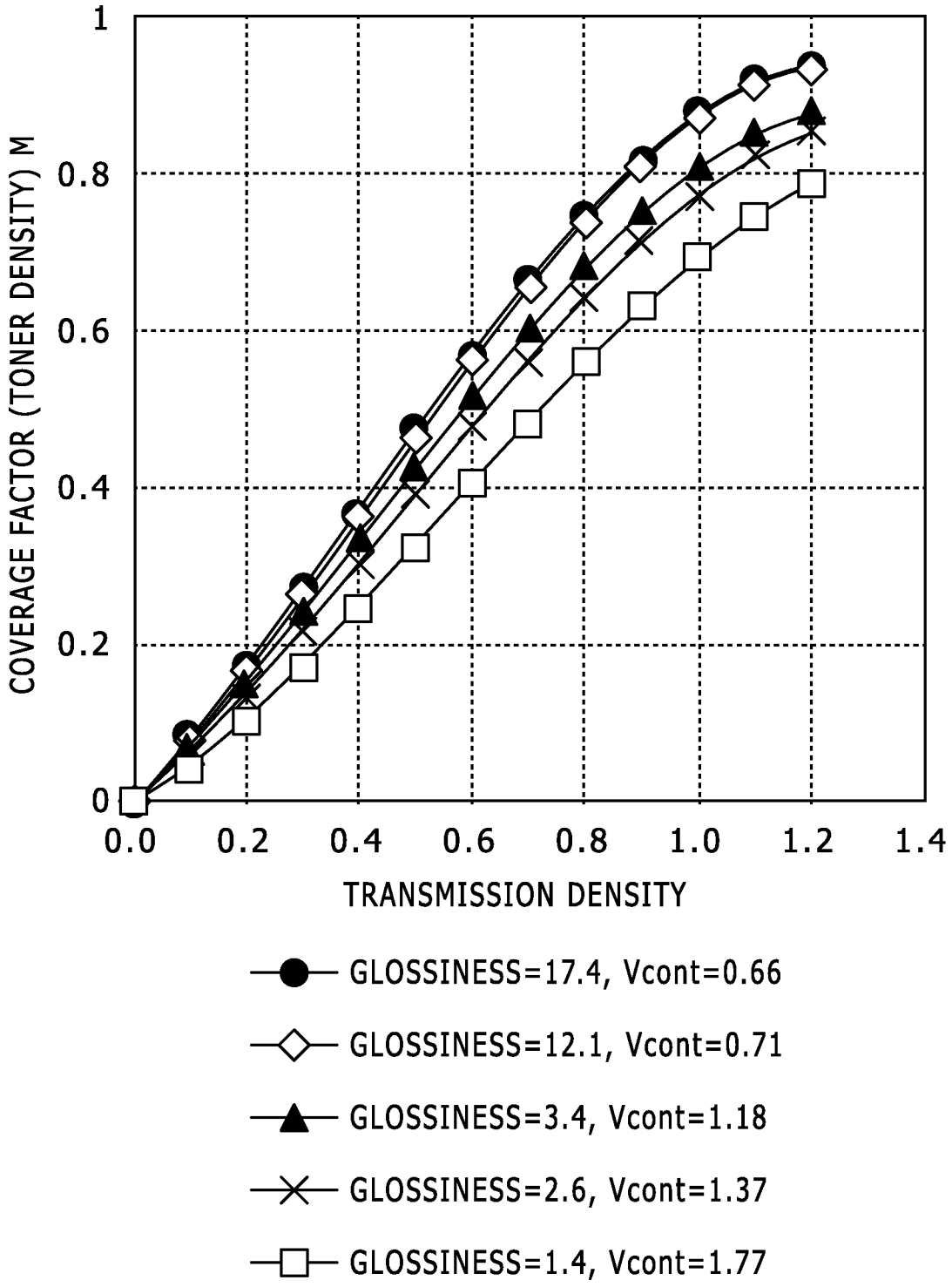
FIG. 7 shows a diagram that indicates a relationship between an actual toner density and a coverage factor (toner density) M at plural states of the reference control voltage Vcont (i.e. the glossiness)

FIG. 7 shows a diagram that indicates a relationship between an actual toner density and a coverage factor (toner density) M at plural states of the reference control voltage Vcont (i.e. the glossiness).

As mentioned, when the glossiness of the intermediate transfer belt 4 changes, even if an actual toner density keeps the same, a measurement value of the toner density (i.e. the coverage factor M) changes as shown in FIG. 7, for example.

Thus, the density determining unit 43 considers as a reference characteristic a characteristic of a measurement value of the toner density (the coverage factor M) when the reference control voltage Vcont is equal to a specific value, and corrects the characteristic of a measurement value of the toner density (the coverage factor M) to the reference characteristic on the basis of a measurement value of the reference control voltage Vcont, and thereby performs the correction corresponding to a change of the glossiness of the intermediate transfer belt 4 for a measurement value of the toner density (the coverage factor M).

Figure 8:
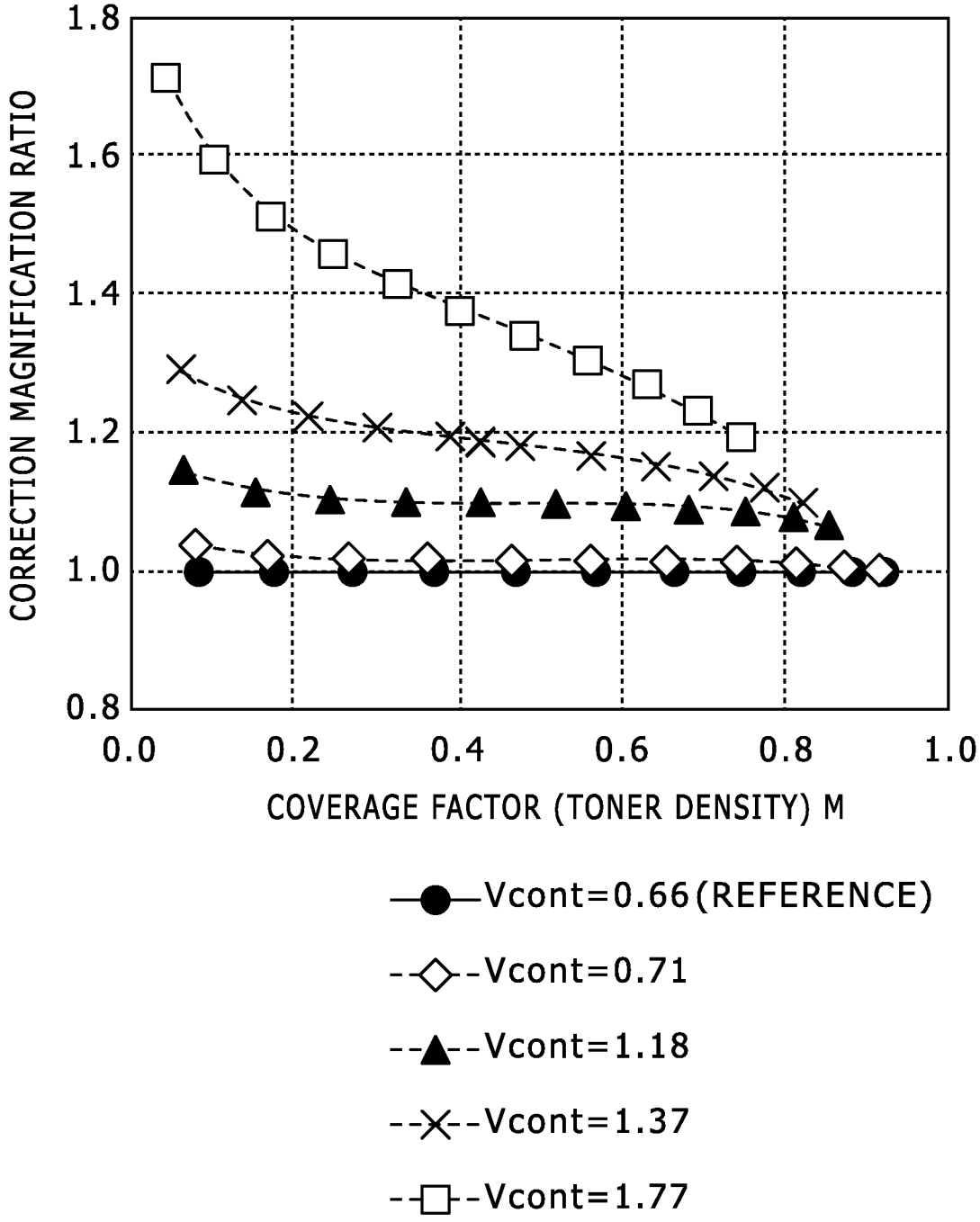
FIG. 8 shows a diagram that indicates a relationship between a coverage factor (toner density) M and a correction magnification ratio (correction amount) at plural states of the reference control voltage Vcont (i.e. the glossiness)
Figure 9:
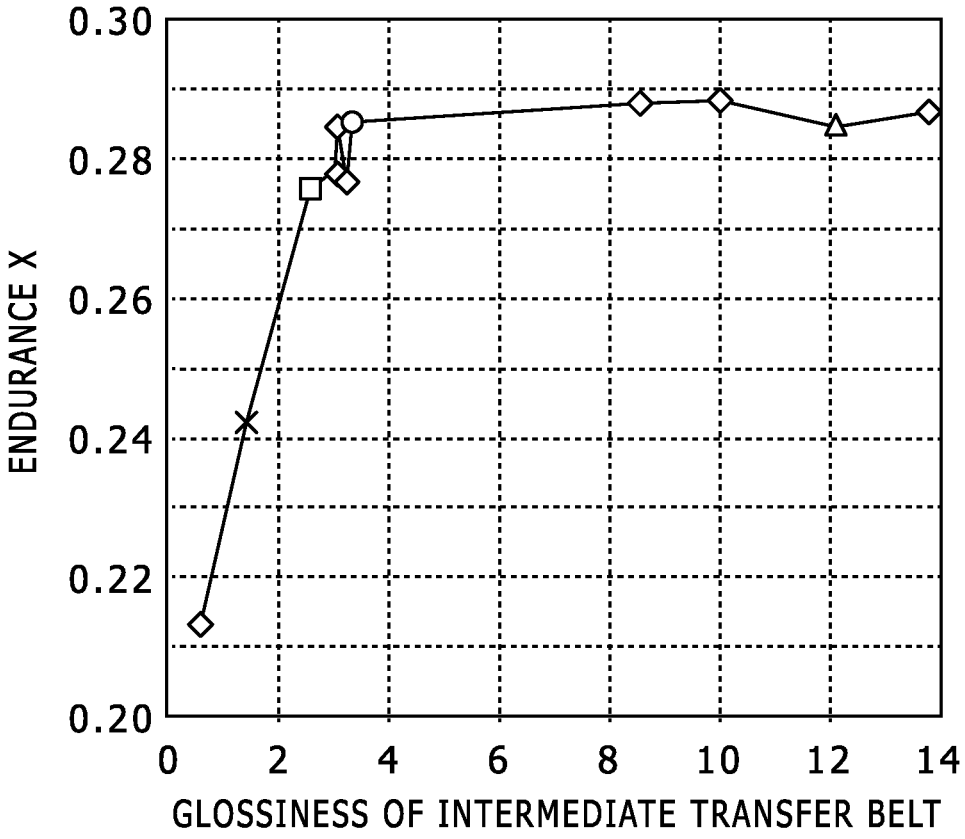
FIG. 9 shows a diagram that indicates an example of a relationship between a glossiness (a measurement value by a glossmeter) and an endurance X at plural conditions of a transfer belt.

FIG. 8 shows a diagram that indicates a relationship between a coverage factor (toner density) M and a correction magnification ratio (correction amount) at plural states of the reference control voltage Vcont (i.e. the glossiness). FIG. 8 indicates an example of a case that the correction parameter G is set to be equal to the reference control voltage Vcont.

For example, correction magnification ratio data as shown in FIG. 8 has been stored in an unshown non-volatile storage device, and the correction magnification ratio data is for correcting a characteristic of a measurement value of the toner density (the coverage factor M) to the reference characteristic on the basis of a measurement value of the reference control voltage Vcont; and the density determining unit 43 determines a correction magnification ratio corresponding to the measurement value of the reference control voltage Vcont and the measurement value of the toner density (the coverage factor M) on the basis of such correction magnification ratio data, and corrects the measurement value of the toner density by multiplying the measurement value of the toner density (the coverage factor M) by this correction magnification ratio.

In the case shown in FIG. 8, the characteristic at Vcont=0.66 is used as the reference characteristic.

The correction magnification ratio data may be stored as a table such as a lookup table or may be stored as data indicating a type of function of the correction magnification ratio (e.g. polynomial function) and a constant used in the function (e.g. a coefficient of each order in the polynomial function).

Thus, a measurement value of the toner density is corrected to a toner density under a condition that a state of the intermediate transfer belt 4 indicates the reference characteristic, and consequently restrained is an influence of a glossiness change of the intermediate transfer belt 4 on the measurement value of the toner density.

The following part explains a behavior of the aforementioned image forming apparatus.

Firstly, the sensor light intensity control unit 42 adjusts light intensity of the light emitter 11 of the sensor 8 so as to set photodetection output of Pg as a predetermined value, determines a reference control voltage Vcont, and drives the light emitter 11 with the reference control voltage Vcont.

The density determining unit 43 determines a value of the correction parameter G from the reference control voltage Vcont (or from the reference control voltage Vcont, Pg, Sg, Pd, Sd), and determines a correction characteristic (a characteristic of the correction magnification ratio to the coverage factor M) corresponding to the determined value of the correction parameter G on the basis of the correction magnification ratio data.

Subsequently, the density determining unit 43 measures the dark potentials Pd and Sd, and measures Pg and Sg of the surface material at a predetermined position of the intermediate transfer belt 4 using the sensor 8.

After the measurement of Pg and Sg of the surface material, the pattern forming unit 41 forms a toner pattern at the predetermined position, and the density determining unit 43 measures P and S of the toner pattern at the predetermined position.

Subsequently, the density determining unit 43 calculates the toner density (the aforementioned coverage factor M) from the measurement values of Pg, Sg, Pd, Sd, P, and S.

The density determining unit 43 determines the correction magnification ratio corresponding to the toner density (the coverage factor M) on the basis of the aforementioned determined correction characteristic. Subsequently, the density determining unit 43 multiplies the aforementioned toner density by the correction magnification ratio determined as mentioned, and thereby obtains the corrected toner density.

In the aforementioned embodiment, the light emitter 11 outputs light with which a toner pattern on the intermediate transfer belt 4 or a surface material of the intermediate transfer belt 4 is irradiated. The photodetectors 15 and 16 receive reflection light from the toner pattern or the surface material of the intermediate transfer belt 4. The sensor light intensity control unit 42 supplies a control voltage to the light emitter 11, and thereby controls light intensity of the light emitter 11. The density determining unit 43 determines a toner density on the basis of output of the photodetectors 15 and 16. Specifically, the density determining unit 43 (*a*) determines a reference control voltage Vcont of the light emitter 11 to set as a predetermined value the output of the photodetector 15 corresponding to the reflection light from the surface material of the intermediate transfer belt 4, (b) determines a correction parameter G corresponding to the reference control voltage Vcont, (c) determines a correction amount corresponding to the correction parameter G and the toner density, and (d) corrects the toner density on the basis of the correction amount.

Thus, the correction amount is decided using the reference control voltage Vcont correlated to the glossiness, and consequently, even though the glossiness of the intermediate transfer belt 4 changes through use, the measured toner density is properly corrected.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, in a case that the index I is used as the correction parameter G, (a) a value of the index I may be determined by measuring Pg, Pd, Sg, and Sd together with measuring the reference control voltage Vcont or (b) a value of the index I may be determined by using Pg and Pd and using Pg and Sg detected from the surface material part at a forming position of a toner pattern when a toner pattern is formed afterward. If a position of the surface material part used for setting the reference control voltage Vcont and a position of the surface material part where an actual toner pattern is formed are different from each other, then Pg and Sg measured at an actual toner pattern toner forming position can correct the toner density at this position more accurately. Therefore, the latter is favorable.

Further, in the aforementioned embodiment, a characteristic at a specific value of the reference control voltage Vcont is set as the reference characteristic, and the correction is performed so as to fit with the reference characteristic. Alternatively, when a measurement value of the toner density is corrected using gamma correction, for example, and thereby a relationship between a measurement value of the toner density and the actual toner density is made close to a linear, gradation levels of the toner density after this correction may be set as the reference characteristic.

Furthermore, in the aforementioned embodiment, the beam splitters 12 and 14 are used as polarizers. Alternatively, another polarizer such as polarizing prism may be used instead thereof.

What is claimed is:

1. An image forming apparatus, comprising:

an image carrier configured to carry a toner pattern;

a sensor that comprises a light emitter and a photodetector, the light emitter configured to output light with which the toner pattern or a surface material of the image carrier is irradiated, the photodetector configured to receive reflection light from the toner pattern or the surface material of the image carrier;

a sensor light intensity control unit configured to provide a control voltage to the light emitter and thereby control light intensity of the light emitter; and a density determining unit configured to determine a toner density on the basis of output of the photodetector;

wherein the density determining unit (a) determines a reference control voltage of the light emitter to set as a predetermined value the output of the photodetector corresponding to the reflection light from the surface material of the image carrier, (b) determines a correction parameter corresponding to the reference control voltage, (c) determines a correction amount corresponding to the correction parameter and the toner density, and (d) corrects the toner density on the basis of the correction amount;

wherein:

the sensor comprises a polarizer, a first photodetector, and a second photodetector, the polarizer splits the reflection light into a P-polarized light component and an S-polarized light component, the first photodetector receives the P-polarized light component, and second photodetector receives the S-polarized light component; and the density determining unit determines a toner density on the basis of outputs of the first photodetector and the second photodetector, wherein the density determining unit (a) determines a reference control voltage of the light emitter to set as a predetermined value the output of the first photodetector corresponding to the reflection light from the surface material of the image carrier, (b) determines a correction parameter corresponding to the reference control voltage, (c) determines a correction amount corresponding to the correction parameter and the toner density, and (d) corrects the toner density on the basis of the correction amount.

2. The image forming apparatus according to claim 1, wherein the correction parameter is proportional to the reference control voltage.

3. The image forming apparatus according to claim 1, wherein the correction parameter is in inverse proportion to the reference control voltage.

4. An image forming apparatus, comprising:

an image carrier configured to carry a toner pattern;

a sensor that comprises a light emitter and a photodetector, the light emitter configured to output light with which the toner pattern or a surface material of the image carrier is irradiated, the photodetector configured to receive reflection light from the toner pattern or the surface material of the image carrier;

a sensor light intensity control unit configured to provide a control voltage to the light emitter and thereby control light intensity of the light emitter; and a density determining unit configured to determine a toner density on the basis of output of the photodetector;

wherein the density determining unit (a) determines a reference control voltage of the light emitter to set as a predetermined value the output of the photodetector corresponding to the reflection light from the surface material of the image carrier, (b) determines a correction parameter corresponding to the reference control voltage, (c) determines a correction amount corresponding to the correction parameter and the toner density, and (d) corrects the toner density on the basis of the correction amount;

wherein:

the correction parameter is proportional to the reference control voltage in a first mode and is in inverse proportion to the reference control voltage in a second mode; and the density determining unit changes one to the other among the first mode and the second mode in accordance with the reference control voltage and determines the correction parameter.

* * * * *